US010681987B2

(12) United States Patent
Liu et al.

(10) Patent No.: US 10,681,987 B2
(45) Date of Patent: Jun. 16, 2020

(54) CONSOLE UNIT HAVING A DOOR COMPARTMENT

(71) Applicants: Chih Hsiung Liu, Benoni (ZA); Mei Jun Xu, Jiujiang (CN)

(72) Inventors: Chih Hsiung Liu, Benoni (ZA); Mei Jun Xu, Jiujiang (CN)

(73) Assignee: HHC CHANGZHOU CORPORATION, Changzhou (CN)

( * ) Notice: Subject to any disclaimer, the term of this patent is extended or adjusted under 35 U.S.C. 154(b) by 0 days.

(21) Appl. No.: 16/155,922

(22) Filed: Oct. 10, 2018

(65) Prior Publication Data

US 2020/0113337 A1 Apr. 16, 2020

(51) Int. Cl.

| | |
|---|---|
| ***A47C 7/62*** | (2006.01) |
| ***A47C 31/00*** | (2006.01) |
| *A47C 7/72* | (2006.01) |

(52) U.S. Cl.

CPC ..... *A47C 7/624* (2018.08); *A47C 31/008* (2013.01); *A47C 7/72* (2013.01)

(58) Field of Classification Search

CPC ..... A47C 7/624; A47C 7/72; A47C 7/622; A47C 7/62; A47C 31/008

USPC ..... 297/188.14–188.17

See application file for complete search history.

(56) References Cited

U.S. PATENT DOCUMENTS

| | | | | |
|---|---|---|---|---|
| 2,502,383 A * | 3/1950 | Osofsky | A47C 7/70 297/145 |
| 2,767,771 A * | 10/1956 | Leonard | A47C 7/70 297/125 |
| 4,719,764 A * | 1/1988 | Cook | F25D 11/00 297/180.14 |
| 5,217,277 A * | 6/1993 | Rasnick | A47B 43/02 297/145 |

(Continued)

*Primary Examiner* — Mark R Wendell

(74) *Attorney, Agent, or Firm* — Law Offices of Steven W. Weinrieb

(57) ABSTRACT

A console unit having a compartment door operatively incorporated therein, and within the upper part of the compartment or door, there is provided a storage receptacle for holding various different items, such as, for example, a book, a magazine, remote control devices, a wireless charging pad, a dock, or alternatively, the storage receptacle comprises at least one cup holder for holding a beverage container, and wherein further a motorized mechanism is provided within the console for moving the component, compartment, or door of the console unit between a first position at which the component, compartment, or door is CLOSED such that the storage receptacle or at least one cup holder is hidden within a forward section of the console unit, and a second position at which the component, compartment, or door is OPENED and projects forwardly and outwardly from the console unit such that the storage receptacle or the at least one cup holder is exposed and may in fact be utilized to hold various items, such as, for example, the aforenoted book, magazine, remote control devices, or a beverage when the storage receptacle comprises a cup holder. The console unit may comprise a stand-alone unit which is adapted to be disposed alongside (Continued)

a lounger chair or interposed between a pair of lounger chairs, or alternatively, the console unit may be integrally incorporated within at least one side wall portion of the lounger chair.

13 Claims, 8 Drawing Sheets

(56) References Cited

U.S. PATENT DOCUMENTS

| | | | | |
|---|---|---|---|---|
| 5,628,544 | A * | 5/1997 | Goodman | A47C 1/14 190/8 |
| 5,890,767 | A * | 4/1999 | Chang | A47C 4/02 297/248 |
| 6,106,058 | A * | 8/2000 | Sur | A47C 7/54 297/188.14 |
| 8,419,124 | B2 * | 4/2013 | Kramer | A47C 7/62 297/116 |
| 9,895,000 | B2 * | 2/2018 | Hassman | A47C 7/62 |
| 2011/0193374 | A1 * | 8/2011 | Kim | B60K 35/00 297/188.16 |
| 2013/0249256 | A1 * | 9/2013 | Payne, Jr. | A47C 7/50 297/161 |

* cited by examiner

CONSOLE UNIT HAVING A DOOR COMPARTMENT

FIELD OF THE INVENTION

The present invention relates generally to furniture, and more particularly to a console unit having a compartment or door operatively incorporated therein, and within the upper part of the compartment or door, there is provided a storage receptacle for holding various different items, such as, for example, a book, a magazine, remote control devices, a wireless charging pad, a dock, or alternatively, the storage receptacle comprises at least one cup holder for holding a beverage container, and wherein further a motorized mechanism is provided within the console for moving the compartment or door of the console unit between a first position at which the compartment or door is CLOSED such that the storage receptacle or at least one cup holder is hidden within a forward section of the console unit, and a second position at which the compartment or door is OPENED and projects forwardly and outwardly from the console unit such that the storage receptacle or the at least one cup holder is exposed and may in fact be utilized to hold various items, such as, for example, the aforenoted book, magazine, remote control devices, wireless charging pad, dock, or a beverage. The console unit may comprise a stand-alone unit which is adapted to be disposed alongside a lounger chair or interposed between a pair of lounger chairs, or alternatively, the console unit may be integrally incorporated within at least one side wall portion of a lounger chair adjacent an arm structure of the chair, or still further may be integrally incorporated within the arm structure of the chair.

BACKGROUND OF THE INVENTION

Lounger chairs or console units are conventionally present within modern living rooms, family rooms, dens, libraries, offices or the like, of residential homes, condominiums, apartments, business offices, and the like. Lounger chairs are chairs wherein, for example, the back portion, the headrest, the seat portion, and a footrest of the chair are operatively connected together by means of a multitude of linkage members comprising an overall linkage system, and at least one motorized actuator is operatively connected to various linkage members comprising the linkage system so that predetermined movements of the back portion, the headrest, the seat portion, and the footrest of the chair are able to be achieved as desired. It is also often the case that a console unit is disposed adjacent to the lounger chair as part of a single furniture setting or arrangement, wherein the console unit is provided with a storage receptacle or a beverage holder within the upper surface portion of the console unit so as to be utilized for the storage of various different objects that may be desired to be used by means of a person sitting in the lounger chair. Such objects may comprise, for example, a book, a magazine, remote control devices, a wireless charging pad, a dock, or a cup holder for holding a beverage. Still further, a console unit may likewise be interposed between a pair of lounger chairs disposed adjacent to each other. Still yet further, a console unit may likewise be structurally incorporated within one or both side portions of the lounger chair.

As noted, the storage receptacle or cup holder is usually provided within an upper forward portion of the console unit and is conventionally or normally open or exposed to the room environment, however, such an open disposition of the storage tray or cup holder presents several problems which some people may not like in connection with the overall décor of the aforenoted living rooms, family rooms, dens, offices, or libraries. For example, since the storage receptacle or cup holder is always open and exposed to the environment within the living rooms, family rooms, dens, or libraries, such storage receptacles or cup holders have a tendency to collect dust and become dirty. Still further, some people may consider such storage receptacles or cup holders aesthetically unpleasing in connection with the overall décor of the particular room, and may desire to have such storage receptacles or cup holders normally hidden and then rendered available for use when desired. Therefore, the storage receptacles or cup holders may be manually manipulable so as to be capable of being manually opened or closed as desired. However, this is not really desirable in view of the fact that the console units are being utilized in conjunction with motorized lounger chairs whereby the person sitting in the chair can readily adjust the back portion, the headrest, the seat portion, and the footrest components of the chair by means of a power unit having a multitude of control buttons which will actuate the at least one motorized actuator in order to achieve various positional adjustments of the back portion, the headrest, the seat portion, and the footrest components of the chair. Accordingly it is desirable for the console compartment or door to likewise be capable of being opened and closed by means of at least one motorized actuator. However, care must be taken when utilizing such a motorized actuator in that the closure of the console compartment or door cannot be too forceful or aggressive or else damage to the actuator motor, or a person's hand, if, for example, a foreign object or a person's hand should be interposed between the movable compartment or door and the chassis of the lounger chair, may occur. For example, if some foreign object becomes jammed in the system while the compartment or door is disposed at its OPEN position, then safety measures must be incorporated within the system for effectively shutting down or preventing further closure of the compartment or door until the foreign object, blocking the closure of the compartment or door, is firstly removed.

A need therefore exists in the art for a new and improved furniture piece. Another need exists in the art for a new and improved furniture piece wherein the furniture piece comprises a console unit. Still another need exists in the art for a new and improved console furniture piece wherein the console furniture piece comprises a stand-alone console furniture piece. Yet another need exists in the art for a new and improved console furniture piece wherein the console furniture piece is effectively incorporated within at least one side end portion of a lounger chair. Yet still another need exists in the art for a new and improved console furniture piece wherein the console furniture piece can be interposed between a pair of lounger chairs. Still yet another need exists in the art for a new and improved console furniture piece wherein the console furniture piece comprises a storage receptacle or at least one cup holder mounted within an upper forward portion of the console furniture piece and is adapted for holding various different objects such as, for example, a book, a magazine, remote control devices, a wireless charging pad, a dock, or a beverage. An additional need exists in the art for a new and improved console furniture piece wherein the storage receptacle or the at least one cup holder is mounted upon a compartment or door which can be moved between a first CLOSED position and a second OPEN position with respect to the console furniture piece such that the storage receptacle or the at least one cup holder can be normally hidden as a result of the compartment or door being disposed at, its CLOSED position and yet exposed when the compartment or door is moved to its OPEN position when access to the storage receptacle is desired so as to gain access to the storage receptacle and its contents, or to the at least one cup holder. Still an additional need exists in the art for a new and improved console furniture piece wherein the compartment or door is moved between the aforenoted CLOSED and OPEN positions by means of at least one motorized actuator mechanism. A further need exists in the art for a new and improved console furniture piece wherein the closure of the compartment or door is regulated so that when the compartment or door is moved from its OPEN position toward its CLOSED position, and is jammed due to some foreign object blocking the closure of the compartment or door from its OPEN position toward its CLOSED position, the movement of the compartment or door from its OPEN position toward its CLOSED position will be terminated for safety reasons until the foreign object is removed.

OVERALL OBJECTIVES OF THE INVENTION

An overall objective of the present invention is to provide a new and improved furniture piece. Another overall objective of the present invention is to provide a new and improved furniture piece wherein the furniture piece comprises a console unit. Still another overall objective of the present invention is to provide a new and improved console furniture piece wherein the console furniture piece comprises a stand-alone console furniture piece. Yet another overall objective of the present invention is to provide a new and improved console furniture piece wherein the console furniture piece is effectively incorporated within at least one side end portion of a lounger chair. Yet still another overall objective of the present invention is to provide a new and improved console furniture piece wherein the console furniture piece can be interposed between a pair of lounger chairs. Still yet another overall objective of the present invention is to provide a new and improved console furniture piece wherein the console furniture piece comprises a storage receptacle or at least one cup holder mounted within an upper forward region of the console furniture piece and is adapted for holding various different objects such as, for example, a book, a magazine, remote control devices, a wireless charging pad, a dock, or a cup holder. Yet still another overall objective of the present invention is to provide a new and improved console furniture piece wherein the storage receptacle or the at least one cup holder is mounted upon a compartment or door which can be moved between a first CLOSED position and a second OPEN position with respect to the console furniture piece such that the storage receptacle or the at least one cup holder can be normally hidden as a result of the compartment or door being disposed at its CLOSED position and yet exposed when the compartment or door is moved to its OPEN position when access to the storage receptacle or at least one cup holder is desired so as to gain access to the storage receptacle and its contents, or to the at least one cup holder. Still yet another overall objective of the present invention is to provide a new and improved console furniture piece wherein the compartment or door is moved between the aforenoted CLOSED and OPEN positions by means of at least one motorized actuator mechanism. A further overall objective of the present invention is to provide a new and improved console furniture piece wherein the closure of the compartment or door is regulated so that when the compartment or door is moved from its OPEN position toward its CLOSED position, and is jammed due to some foreign object blocking the closure of the compartment or door from its OPEN position toward its CLOSED position, the movement of the compartment or door from its OPEN position toward its CLOSED position will be terminated for safety reasons until the foreign object is removed.

SUMMARY OF THE INVENTION

The foregoing and other objective are achieved in accordance with the principles and teachings of the present invention through the provision of a new and improved furniture piece which comprises a console unit, and wherein the console unit can comprise either a stand-alone unit, can be integrally incorporated within at least one side end portion of a lounger chair, or can be interposed between two lounger chairs. In accordance with a first embodiment, wherein the console unit is used as a stand-alone console, the stand-alone console is provided with a substantially upright back portion, a horizontal "seat" portion, and a compartment or door which is movably mounted upon a front face frame portion of the console unit so as to be pivotally movable around a horizontally oriented axis located within the lower front end portion of the console unit housing or chassis. The console is not actually intended to serve as a chair for a person to sit in, but, to the contrary, comprises the upright back portion and the horizontal "seat" portion simply as a means for aesthetically blending in or being aesthetically compatible with the one or more lounger chairs. The "seat" portion is actually a cover which can be pivotally opened so as to uncover a compartment or door within the console which may be used for storing various objects. The compartment or door of the console may have a storage receptacle or the like formed within the upper forward section thereof for storing various objects that a person, sitting in one of the lounger chairs, may choose to use, such as, for example, a book, a magazine, remote control devices, a wireless charging pad, a dock, and the like. Alternatively, the upper forward section of the compartment or door may have at least one cup-holder formed therein for accommodating a beverage. The location of the console unit, in proximity to at least one of the lounger chairs, renders the availability of the various objects, such as, the aforenoted book, magazine, remote control devices, wireless charging pad, dock, and the like, or the beverage, convenient for the person sitting in one of the lounger chairs.

Alternatively, still further, the console unit may be integrally incorporated within at least one side end portion of the lounger chair. In accordance with this second embodiment of the console unit, which effectively comprises a first embodiment wherein the console is integrally incorporated within at least one side end portion of the lounger chair, the compartment or door of the console unit can be actuated so as to pivotally move outwardly and forwardly around a horizontally oriented axis located within a lower end portion of the console unit housing or chassis. Still yet further, a third embodiment of the console unit, which effectively comprises a second embodiment wherein the console is integrally incorporated within at least one side end portion of the lounger chair, the compartment or door of the console unit can be actuated so as to pivotally move outwardly and horizontally, or circumferentially around a vertically oriented axis located within a laterally outward portion of the console unit housing or chassis.

Still yet further, regardless of which console unit embodiment is being utilized, the actuating mechanism for moving the compartment or door from the CLOSED position to the OPEN POSITION and back to the CLOSED position may comprise one of two different embodiments. In accordance with a first embodiment, a rotary driven screw-threaded actuator mechanism comprises an actuator housing from which a threaded rod is extended axially when the actuator mechanism is rotated in a first direction by means of a bi-directional drive motor, and wherein the distal end portion of the threaded rod engages a mounting bracket fixedly mounted upon an internal wall portion of the compartment or door. When the threaded rod is fully extended, the distal end portion of the threaded rod will engage the mounting bracket fixedly mounted upon the internal wall portion of the compartment or door whereby the compartment or door will be disposed at its fully OPEN position at which time, for example, at least one cup holder, disposed within an upper, horizontally disposed platform portion of the compartment or door, will now project outwardly from the compartment or door and therefore be capable of accommodating a beverage. A return spring is fixedly secured at one end to the actuator housing and is likewise fixedly secured at its opposite end to an extension bracket which, in turn, is fixedly connected to the mounting bracket. Accordingly, when the bi-directional drive motor is rotated in the opposite direction, the threaded rod will be retracted into the actuator housing, thereby permitting the biasing spring to return the compartment or door to its CLOSED position. Safety is inherently built into this system in view of the fact that if some foreign object becomes interposed between the open compartment or door and any component part of the housing or chassis of the console unit, the return spring is not strong enough to overcome the interdisposition of the foreign object and the housing or chassis of the console unit so as to nevertheless return the compartment or door to its fully CLOSED position. Accordingly, the drive motor will be deactivated until the foreign object has been removed. This safety feature prevents any harm being done to the foreign object, which could be animate or inanimate, until the same is removed from its obstructive disposition between the compartment or door and the housing or chassis of the console unit.

In accordance with a second embodiment of the actuating mechanism, a rotary driven screw-threaded actuator mechanism likewise comprises an actuator housing from which a threaded rod is extended axially when the actuator mechanism is rotated in a first direction by means of a bi-directional drive motor, and wherein the distal end portion of the threaded rod is operatively connected to the mounting bracket fixedly mounted upon the internal wall portion of the compartment or door. When the threaded rod is fully extended, the compartment or door will be disposed at its fully OPEN position at which time, for example, at least one cup holder, disposed within an upper, horizontally disposed platform portion of the compartment or door, will now project outwardly from the compartment or door and therefore be capable of accommodating a beverage. However, because the distal end portion of the threaded rod simply is operatively connected to the mounting bracket fixedly mounted upon the internal wall portion of the compartment or door, and the return spring of the first embodiment of the actuating mechanism has been eliminated, in accordance with this second embodiment of the actuating mechanism, the drive motor is electronically monitored by means of a suitable power control unit which monitors the RPM of the motor as well as the amperage drawn by the drive motor. If either of these parameters exceeds the limits pre-programmed into the control unit, which would indicate that the rotary drive motor is attempting to drive the threaded rod with greater power so as to, for example, overcome an obstacle that may have become interposed between the compart or door and the housing or chassis of the console unit, the rotary drive of the drive motor is immediately reversed or terminated until the foreign object has been removed. This safety feature therefore operates in a similar manner so as to prevent the drive motor from being burned out due to excessive operation beyond acceptable power limits, and also prevents any harm being done to the foreign object, which could be animate or inanimate, until the same is removed from its obstructive disposition between the compartment or door and the chassis of the console unit.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

FIGS. 6*a* and 6*b*, is actually disposed internally within the console unit and utilized to open and close the compartment or door of the console unit, the compartment or door being illustrated in its CLOSED position in this figure;

DETAILED DESCRIPTION OF THE ILLUSTRATED EMBODIMENTS

Figure 1:
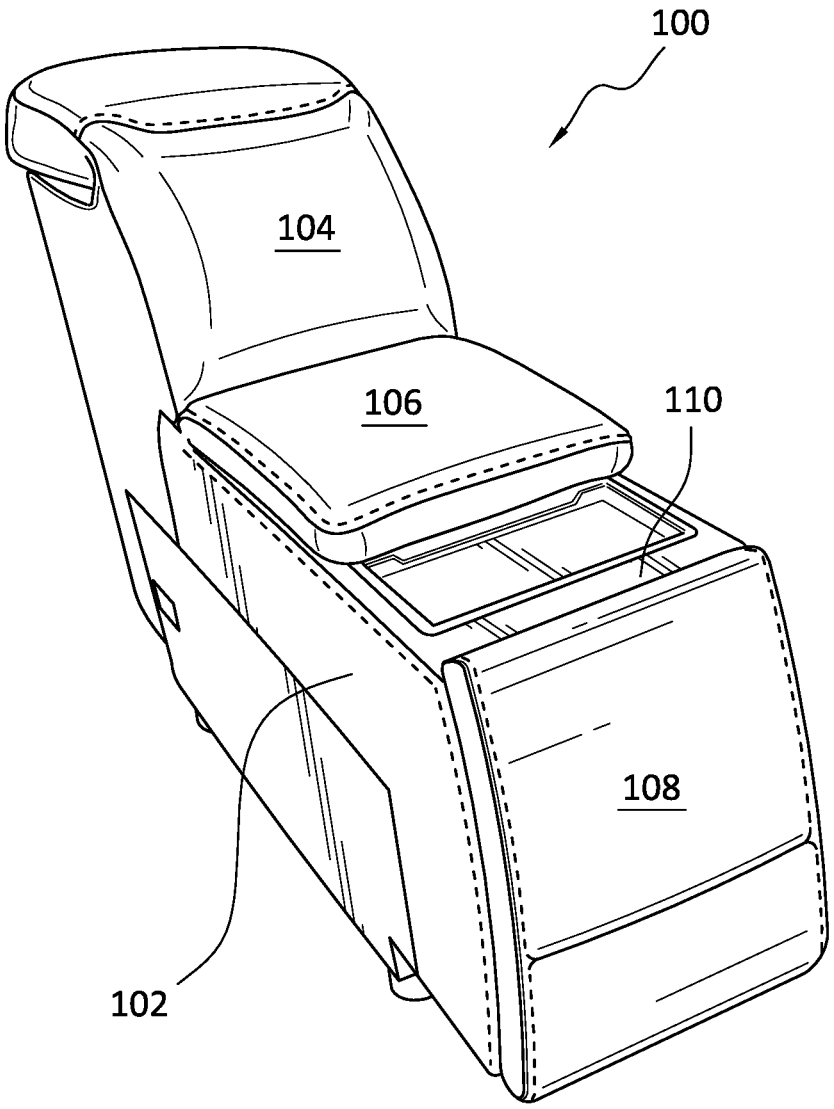
FIG. 1 is a front, left side, top perspective view of a first embodiment of a new and improved furniture console unit wherein the furniture console unit comprises a stand-alone console unit which is to be disposed alongside a lounger chair or interposed between a pair of lounger chairs, and wherein the console unit comprises a compartment or door mounted upon the front end portion of the console unit and is adapted be pivotally moved around a lower horizontally oriented axis disposed within the housing or chassis of the console unit so as to be movable from a first CLOSED position at which, for example, at least one cup holder, disposed within an upper, horizontally oriented platform section of the compartment or door, is hidden from view as a result of being disposed internally within the housing or chassis portion of the console unit, and a second OPEN position at which the at least one cup holder projects outwardly from the housing or chassis of the console unit so as to be capable of accommodating a beverage, FIG. 1 disclosing the compartment or door in its CLOSED position.

Referring now to the drawings, and more particularly to FIG. 1 thereof, a first embodiment of a new and improved furniture piece which comprises a console unit which is disclosed and generally indicated by the reference character 100. While the console unit can comprise either a stand-alone unit or can be integrally incorporated within at least one side end portion of a lounger chair chassis, or, still further, interposed between a pair of lounger chairs, as will be more fully disclosed hereinafter, in accordance with this first embodiment of the console unit 100, the console unit 100 comprises a stand-alone console unit wherein the console unit can be disposed adjacent to one side of a lounger chair, or alternatively, may be interposed between a pair of lounger chairs. The stand-alone console unit 100 comprises a console chassis or housing 102 which, in turn, comprises a substantially upright back portion 104, a horizontal "seat" portion 106, and a compartment or door 108 which is movably mounted upon a front face framework portion 110 of the console unit chassis 102 so as to be pivotally movable around a horizontally oriented axis 113 located within the lower front end portion of the console chassis or housing 102 as will be disclosed more fully hereinafter. The console unit 100 is not actually intended to serve as a chair for a person to sit in but, to the contrary, comprises the upright back portion 104 and the horizontal "seat" portion 106 simply as a means for aesthetically blending in or being aesthetically compatible with the one or more lounger chairs. The "seat" portion 106 is actually a cover which can be pivotally opened in an upward manner so as to uncover a compartment, not shown, that is defined within the console housing or chassis 102 and which may be used for storing various different objects. The compartment or door 108 of the console unit 100 may have a storage receptacle formed within the upper forward section or platform region 111 thereof for storing various objects that a person, sitting in one of the lounger chairs, may choose to use, such as, for example, a book, a magazine, remote control devices, a wireless charging pad, a dock, or the like. Alternatively, the platform member 111 may serve as a platform section within which at least one cup-holder 112 is disposed, as disclosed within FIG. 2, for accommodating a beverage. The location of the console unit 100, in proximity to at least one of the lounger chairs, renders the availability of the various objects, such as, the aforenoted book, magazine, remote control devices, wireless charging pad, dock, or the beverage, convenient for the person sitting in one of the lounger chairs.

Figure 3:
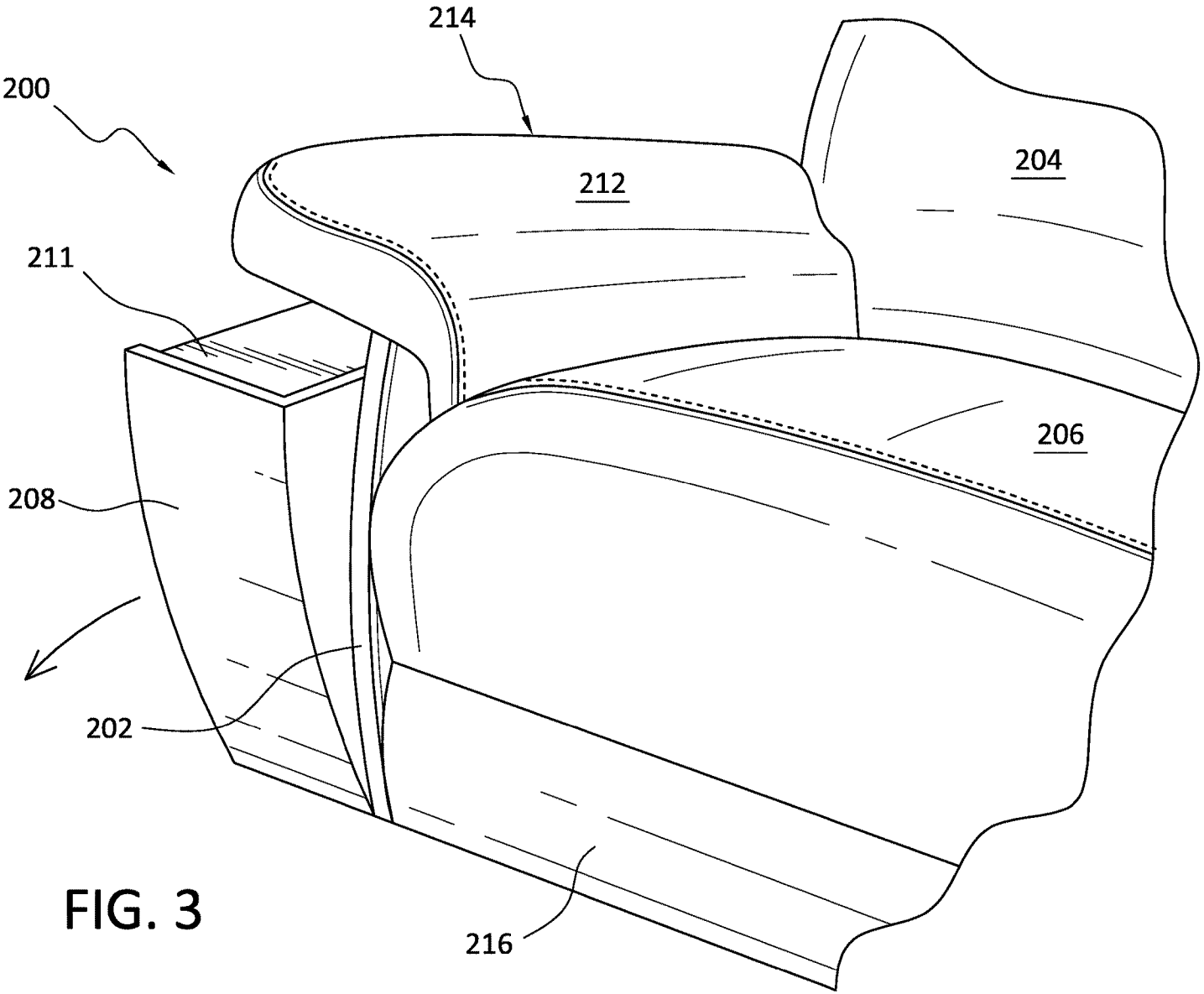
FIG. 3 is a front, right side, top perspective view of a second embodiment of a console unit wherein the console unit effectively comprises an integral part of a lounger chair chassis, more particularly a side arm portion of the lounger chair chassis, and wherein the compartment or door of the console unit is movable in a manner similar to that disclosed within FIGS. 1 and 2.

Alternatively, as disclosed within FIG. 3, the console unit may be integrally incorporated within at least one side end portion 212 of a lounger chair 214. In accordance with a second embodiment of the console unit, which effectively comprises a first embodiment wherein the console unit is integrally incorporated within at least one side end or arm portion 212 of the lounger chair 214, which is disclosed within FIG. 3, and which is generally indicated by the reference character 200, the compartment or door 208 of the console unit 200 can be actuated so as to pivotally move outwardly and forwardly around a horizontally oriented axis located within a lower end portion of the housing or chassis 202 of the console unit 200 as will be disclosed hereinafter. It is to be appreciated that the lounger chair 216 further, comprises an upright back portion 204 and a seat portion 206, it being appreciated that component parts of the second embodiment console unit 200 which correspond to component parts of the first embodiment console unit 100 have been provided with corresponding reference numbers except that they are within the 200 series.

Figure 4:
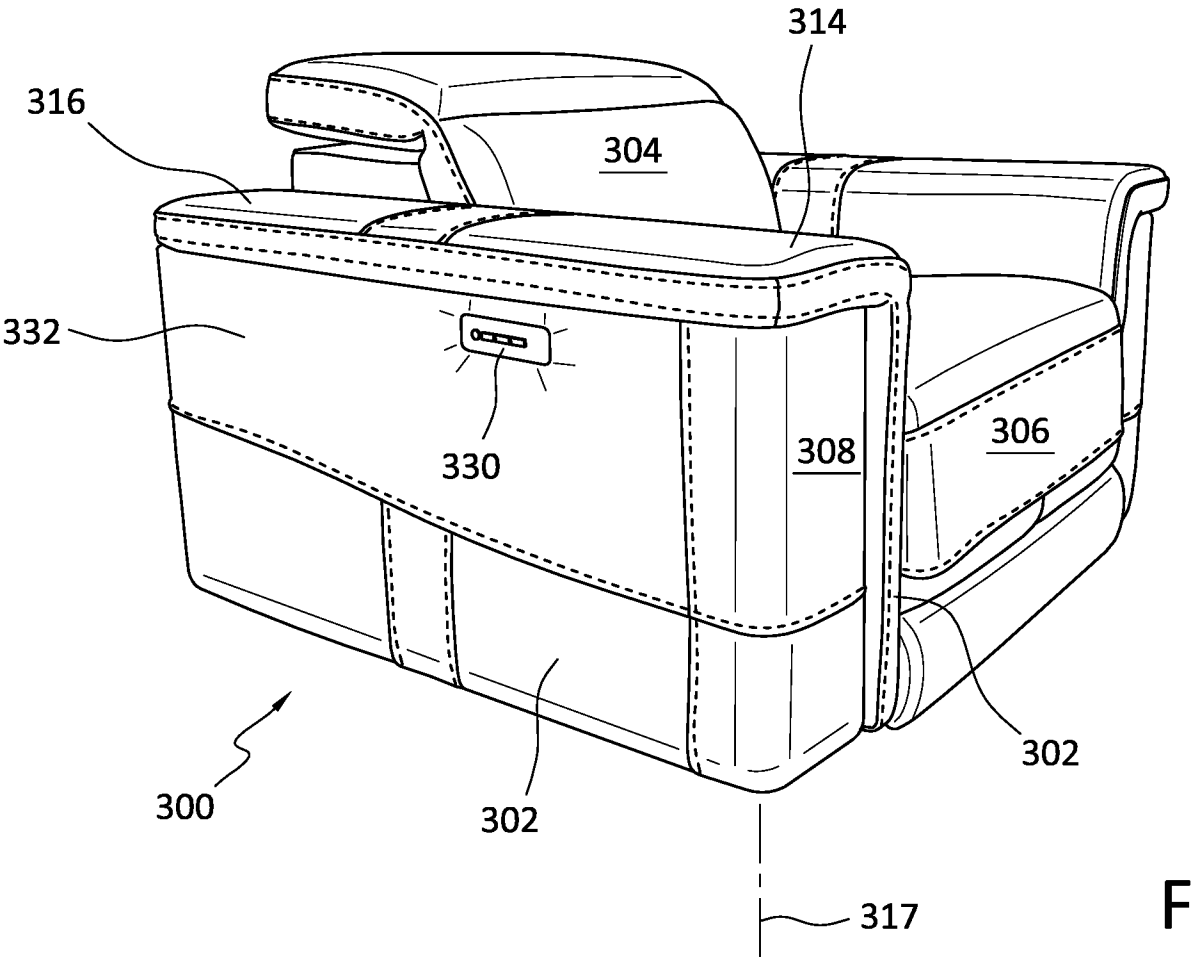
FIG. 4 is a front, left side, top perspective view of a third embodiment of a console unit wherein the console units effectively comprise integral parts of a lounger chair housing or chassis, more particularly side arm portions of the lounger chair housing or chassis, similar to the embodiment illustrated within FIG. 3, wherein, however, the compartments or doors of the console unit are pivotally movable around vertically oriented axes disposed within the lounger chair housing or chassis, are disposed upon opposite sides of the lounger chair housing or chassis, and wherein only a single cup holder is mounted within each upper forward end portion of each compartment or door.
Figure 5:
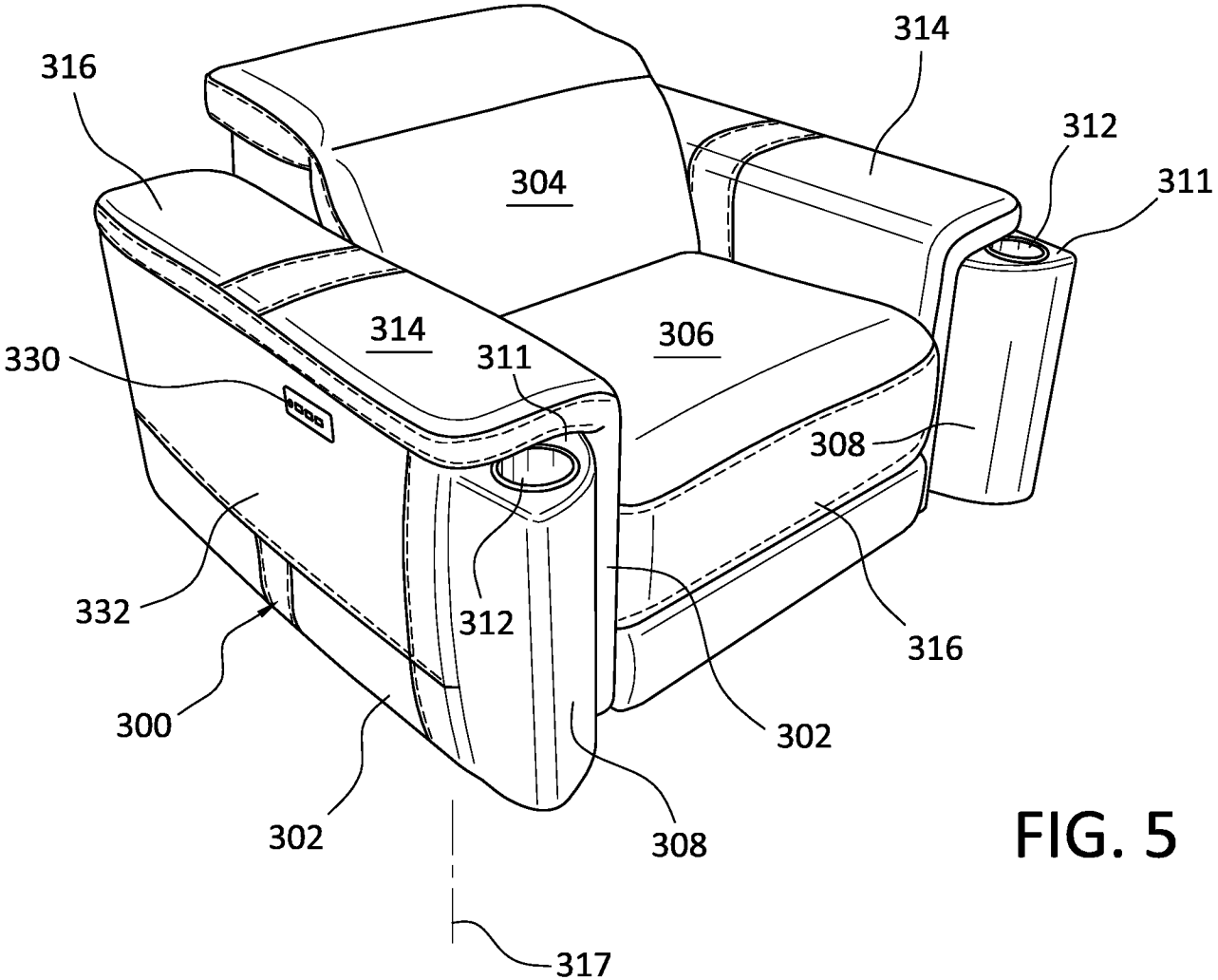
FIG. 5 is a view similar to that of FIG. 4 showing, however, the compartments or doors disposed at its OPEN position wherein it is seen that the pair of cup holders are respectively mounted within the upper, horizontally oriented platform section of each compartment or door operatively associated with each side arm portion of the lounger chair.

Continuing further, and with reference being made to FIGS. 4 and 5, a third embodiment of a console unit, which effectively comprises a second embodiment wherein the console is integrally incorporated within at least one side end portion of a lounger chair, particularly within the oppositely located arm structures of the lounger chair, is disclosed and is generally indicated by the reference character 300. As was the case with the embodiment of the console unit 200 as disclosed within FIG. 3, component parts of the third embodiment console unit 300 which correspond to component parts of the first and second embodiment console units 100,200 have been provided with corresponding reference numbers except that they are within the 300 series. In accordance with this third embodiment of the console unit 300, the compartments or doors 308 of the console unit 300 can be actuated so as to pivotally move outwardly and horizontally, or in effect, circumferentially, around vertically oriented axes 317 which are located within the forward corner regions of laterally outward portions 332 of each console unit or housing 302 which have been structurally integrated within opposite side end portions 314 of the lounger chair 316.

Figure 2:
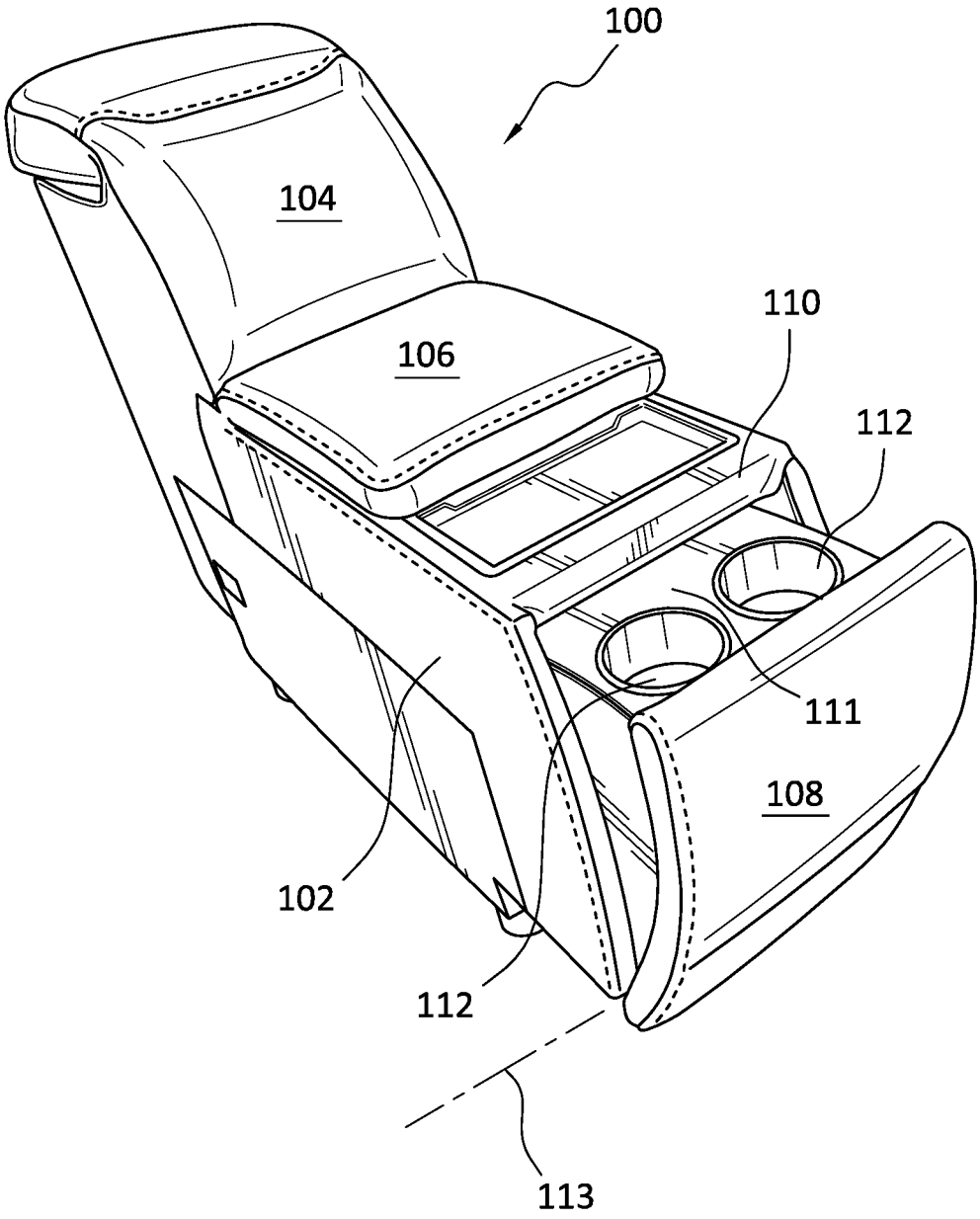
FIG. 2 is a view similar to that of FIG. 1 showing, however, the compartment or door disposed at its OPEN position wherein it is seen that a pair of cup holders are mounted within the upper, horizontally oriented platform section of the compartment or door.
Figure 6A:
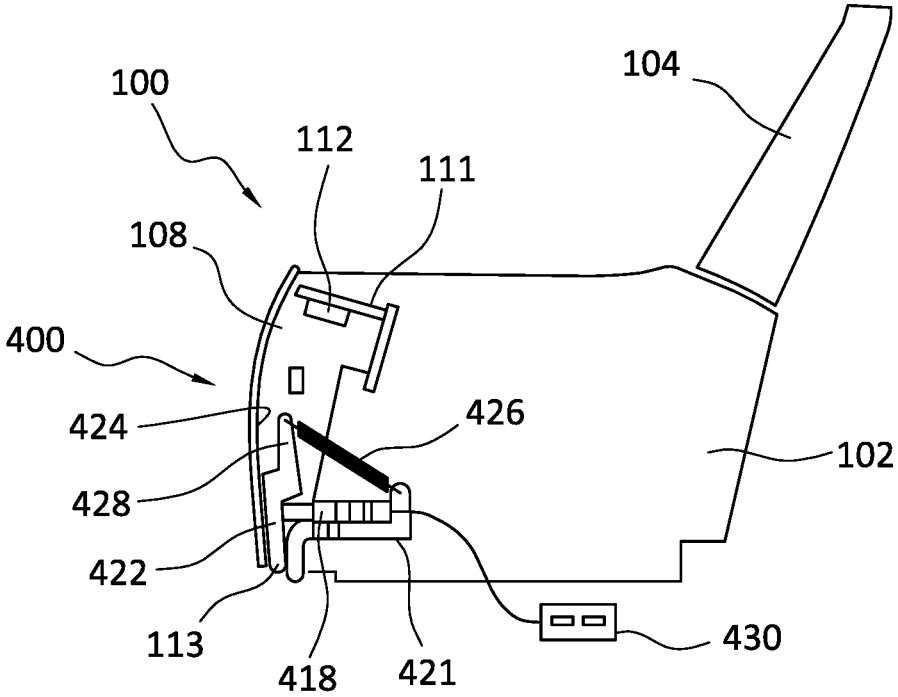
FIG. 6*a* is a schematic view of a first embodiment of an actuating mechanism to be utilized in conjunction with the console units disclosed within FIGS. 1-3 wherein the compartment or door is pivotally movable around a lower horizontally oriented axis disposed within the console unit housing or chassis and wherein the compartment or door is shown at its CLOSED position.
Figure 6B:
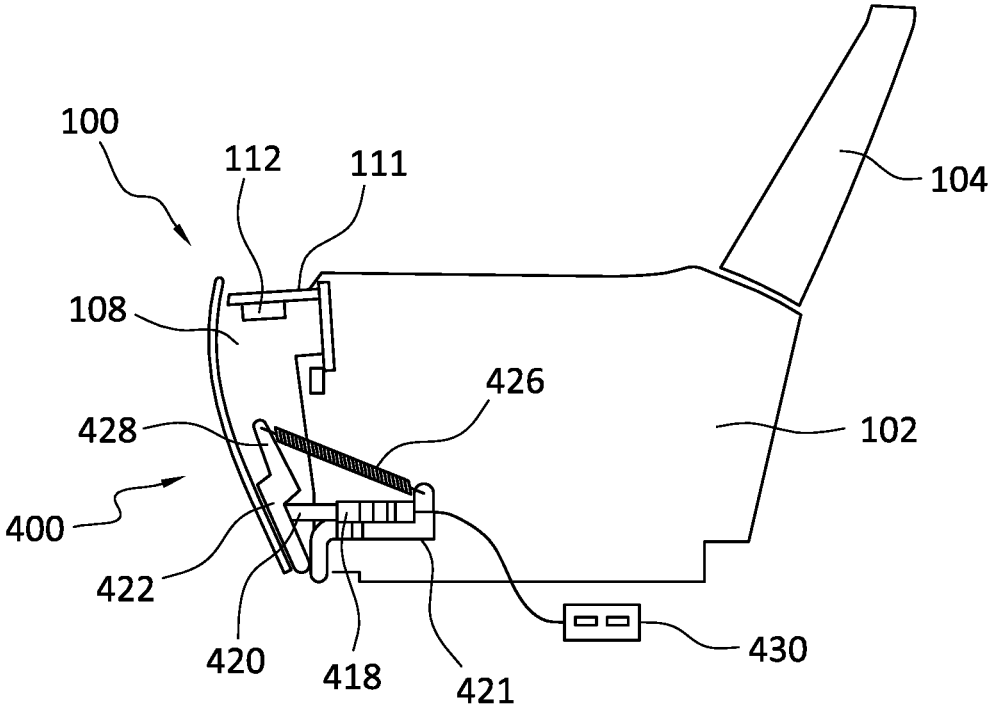
FIG. 6*b* is a schematic view of the first embodiment of the actuating mechanism to be utilized in conjunction with the console units disclosed within FIGS. 1-3, as illustrated within FIG. 6*a*, and wherein the compartment or door is shown at its OPEN position.
Figure 7A:
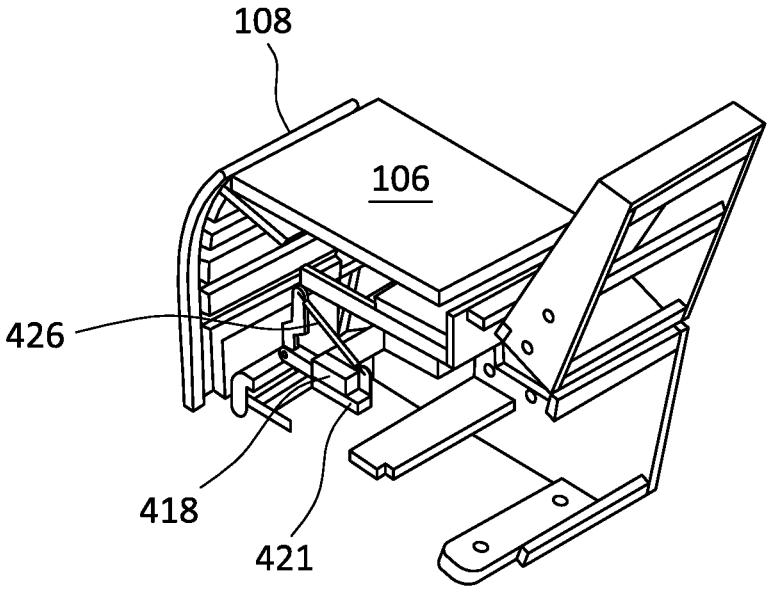
FIG. 7*a* is a left side, rear, top perspective view of the console unit as disclosed within FIGS. 1 and 2, except for the fact that the left side of the console unit has been removed so as to show how the actuating mechanism, as disclosed within
Figure 7B:
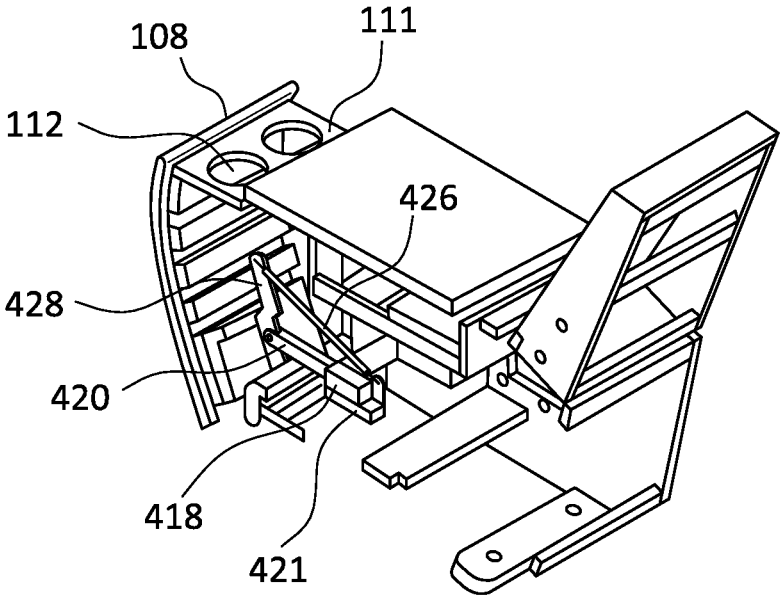
FIG. 7*b* is a left side, rear, top perspective view of the console unit as disclosed within FIG. 7*a*, showing how the actuating mechanism is actually utilized to dispose the compartment or door of the console unit at its OPEN position.

It is to be appreciated that regardless of which console unit embodiment is being utilized, that is, the console unit 100 as disclosed within FIGS. 1 and 2, the console unit 200 as disclosed within FIG. 3, or the console unit 300 as disclosed within FIGS. 4 and 5, the actuating mechanism for moving the compartments or doors from their CLOSED positions to their OPEN positions and back to the CLOSED positions may comprise one of two different embodiments. In accordance with a first embodiment of a suitable actuating mechanism, as disclosed within FIGS. 6*a*-7*b* and as generally indicated by the reference character 400, the actuating mechanism may comprise a linear actuator which may be, for example, a rotary driven screw-threaded actuator mechanism 400 comprises an actuator housing 418 from which a threaded rod 420 is extended axially when the actuator mechanism 400 is rotated in a first direction by means of a bi-directional drive motor 421, and wherein the distal end portion of the threaded rod 420 engages a mounting bracket 422 which is fixedly mounted upon an internal wall portion 424 of the compartment or door 108. When the threaded rod 420 is fully extended as disclosed within FIG. 6*b*, the distal end portion of the threaded rod 420 will engage the mounting bracket 422 such that the compartment or door 108 will be pivoted around the horizontally oriented axis 113 and will be disposed at its fully OPEN position at which time, for example, the at least one cup holder 112, disposed within the upper, horizontally disposed platform portion 111 of the compartment or door 108, will now project outwardly from the front face 110 of the console unit 100 and will therefore be capable of accommodating a beverage. A return spring 426 is fixedly secured at one end to the actuator housing 418 and is likewise fixedly secured at its opposite end to an extension bracket 428 which, in turn, is fixedly connected to the mounting bracket 422.

Accordingly, when the bi-directional drive motor 421 is rotated in the opposite direction, the threaded rod 420 will be retracted into the actuator housing 418, thereby permitting the biasing spring 426 to return the compartment or door 108 to its CLOSED position. Safety is inherently built into this system in view of the fact that if some foreign object becomes interposed between the open compartment or door 108 and any component part of the housing or chassis 102, the threaded rod 420 will continue to be retracted into the actuator housing 418, however, the return spring 426 is not strong enough to overcome the interdisposition of the foreign object and the compartment or door 108 so as to forcefully return the compartment or door 108 to its fully CLOSED position. This safety feature prevents any harm being done to the foreign object, which could be animate or inanimate, until the same is removed from its obstructive disposition between the compartment or door 108 and component part of the housing or chassis of the console unit 102. It is lastly noted that the drive motor 421 is controlled by means of a portable remote-control unit 430. Alternatively, as disclosed within FIGS. 4 and 5, in lieu of the portable remote-control unit 430, a control panel 330 can be built into a side wall portion 332 of the console unit 300.

Figure 8A:
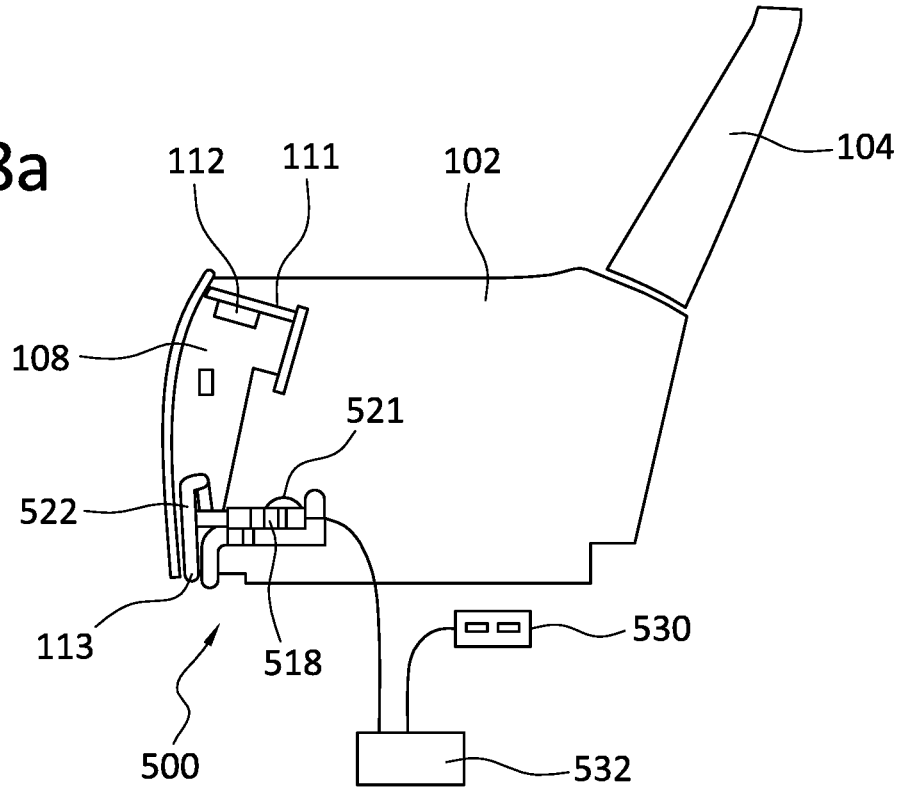
FIG. 8*a* is a schematic view of a second embodiment of an actuating mechanism to be utilized in conjunction with the console units disclosed within FIGS. 1-3 wherein the compartment or door is pivotally moved around a lower horizontally oriented axis disposed within the housing or chassis of the console unit and wherein the compartment or door is shown at its CLOSED position.
Figure 8B:
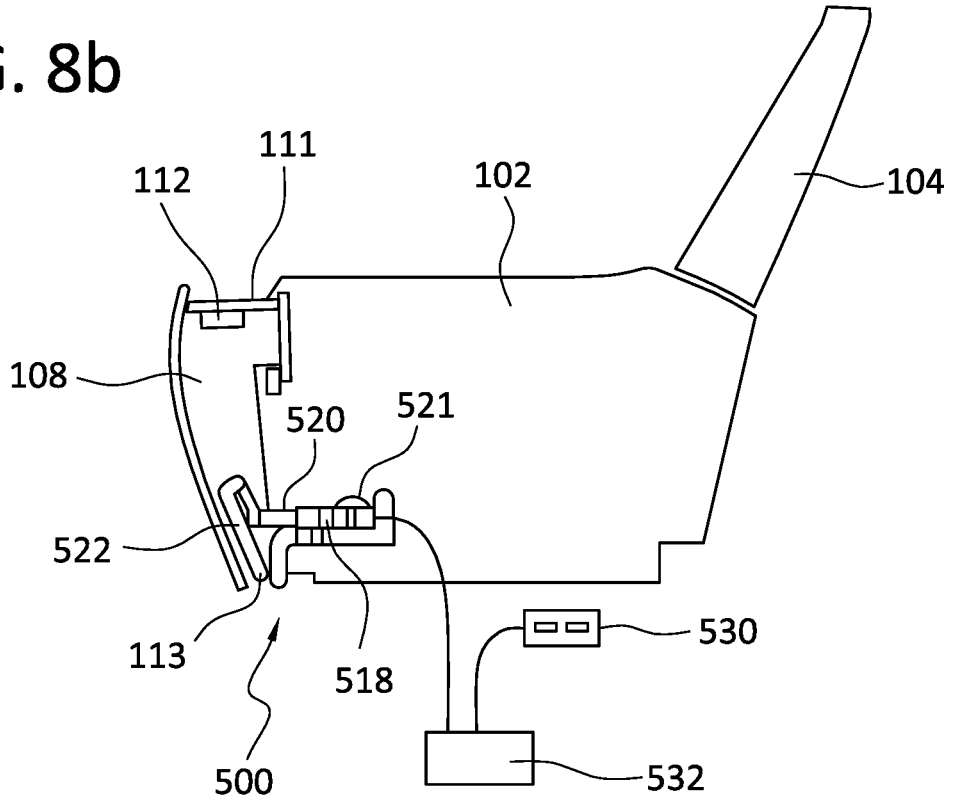
FIG. 8*b* is a schematic view of the second embodiment of the actuating mechanism to be utilized in conjunction with the console units disclosed within FIGS. 1-3, as illustrated within FIG. 8*a*, and wherein the compartment or door is shown at its OPEN position.

With reference lastly being made to FIGS. 8*a* and 8*b* a second embodiment of a suitable actuating mechanism, comprising a rotary driven screw-threaded actuator mechanism likewise comprising an actuator housing 518 from which a threaded rod 520 is extended axially when the actuator mechanism is rotated in a first direction by means of a bi-directional drive motor 521, is disclosed and is generally indicated by the reference character 500. Again, it will be appreciated that component parts of the second embodiment actuating mechanism which correspond to component parts of the first embodiment actuating mechanism will be designated by corresponding reference numbers except that they will be in the 500 series. It is additionally noted that the first and second embodiments of the actuating systems are substantially the same with three exceptions. The first exception is that in the second actuating system 500, the return biasing spring 426 has been eliminated. The second exception is that a power control unit 532 has been electronically interposed between the remote control 530 and the drive motor 521. The third exception is that the threaded rod 520 of the second actuating mechanism 500 is fixedly connected to the mounting bracket 522 as opposed to simply engaging the mounting bracket 422 as was the case of the first embodiment actuating system 400. Accordingly, when the drive motor 521 is driven in the reverse direction, it will directly pull upon the mounting bracket 522. Therefore, if a foreign object becomes interposed between the compartment or door 108 and any component part of the console unit chassis 102, continued operation of the drive motor 521 can be dangerous. Therefore, the drive motor 521 is electronically monitored by means of the power control unit 532 which monitors the RPM of the drive motor 521 as well as the amperage drawn by the drive motor 521. If either of these parameters exceeds the limits pre-programmed into the power control unit 532, which would indicate that the rotary drive motor 521 is attempting to drive the threaded rod with greater power than is normal so as to, for example, overcome an obstacle that may have become interposed between the compart or door 108 and any component part of the housing or chassis 102 of the console unit 100, the rotary drive of the drive motor 521 is immediately reversed or terminated until the foreign object has been removed. This safety feature therefore operates in a similar manner so as to prevent the drive motor 521 from being burned out due to excessive operation beyond acceptable power limits, and also prevents any harm being done to the foreign object, which could be animate or inanimate, until the same is removed from its obstructive disposition between the compartment or door 108 and any component part of the housing chassis 102 of the console unit 100.

Obviously, many variations and modifications of the present invention are possible in light of the above teachings. It is therefore to be understood that within the scope of the appended claims, the present invention may be practiced otherwise than as specifically described herein.

REFERENCE NUMBER KEY

100—First embodiment console unit
102—Housing of console unit'
104—Back rest portion of console unit
106—Seat portion of console unit
108—Compartment door of console unit
110—Front face framework of console unit
111—Platform within which cup-holders 112 are disposed
112—Cup holders
113—Horizontally oriented pivot axis
200—Second embodiment console unit
202—Housing for compartment door
208—Compartment door of console unit
204—Back portion of lounger chair
206—Seat portion of lounger chair
208—Compartment door
211—Platform within which cup holders are disposed
214—Arm portion of lounger chair
300—Third embodiment console
302—Housing for compartment door

304—Back portion of lounger chair
306—Seat portion of lounger chair
308—Compartment door
310—Framework of lounger chair
314—Arm portion of lounger chair
316—Lounger chair
317—Vertically oriented axes
330—Control panel incorporated within side wall portion of housing 302
332—Side wall portion of housing 302
400—First embodiment of actuating mechanism system
418—Linear actuator
420—Extension rod of actuator
421—Drive motor
422—Mounting bracket
424—Internal face of compartment door
426—Return spring
428—Extension bracket
430—Control unit for drive motor
500—Second embodiment of actuating system
518—Linear actuator
520—Extension rod of actuator
521—Drive motor
522—Mounting bracket
524—Internal face of compartment door
528—Extension bracket
530—Control unit for drive motor
532—Control box

What is claimed is claimed as new and desired to be protected by Letters Patent, is:

1. A furniture console unit to be used in conjunction with a chair and having a motorized mechanism for opening and closing a compartment, comprising:

a housing defined within at least one front corner section of said chair;

a compartment pivotally mounted within said at least one front corner section of said housing of said chair for movement around a vertically oriented axis between OPEN and CLOSED positions with respect to said at least one corner section of said chair;

a storage receptacle defined within an upper forward section of said compartment and adapted for holding at least one object a person sitting in said chair adjacent to said console would want to access; and a motorized mechanism operatively associated with said compartment for moving said compartment from said CLOSED position, at which said storage receptacle would be hidden within said at least one front corner section of said housing of said chair, and an OPEN position at which said compartment would move out from said at least one front corner section of said housing of said chair so as expose said storage receptacle such that a person sitting in said chair could access the object held within said storage receptacle.

2. The furniture console as set forth in claim 1, wherein:

said furniture console comprises a stand-alone furniture console.

3. The furniture console as set forth in claim 2, wherein:

said furniture console comprises a front face framework; and said compartment moves outwardly from said front face framework.

4. The furniture console as set forth in claim 2, wherein:

said storage receptacle comprises at least one cup holder for holding at least one beverage.

5. The furniture console as set forth in claim 4, wherein:

said at least one cup holder comprises a pair of cup holders.

6. The furniture console as set forth in claim 5, wherein:

said portion of said chair comprises a side arm portion of said chair.

7. The furniture console as set forth in claim 1, wherein:

said housing of said furniture console is integrally connected to a portion of the chair.

8. The furniture console as set forth in claim 7, wherein:

said compartment is pivotally mounted around a vertically oriented axis defined within said housing integrally connected to said portion of said chair so as to move circumferentially around said vertically oriented axis when said compartment door is pivotally moved from said CLOSED position to said OPEN position.

9. The furniture console as set forth in claim 8, wherein:

said storage receptacle comprises at least one cup holder for holding at least one beverage.

10. The furniture console as set forth in claim 1, wherein:

said motorized mechanism comprises a linear actuator.

11. The furniture console as set forth in claim 10, wherein:

said linear actuator comprises a bi-directional drive motor.

12. The furniture console as set forth in claim 11, further comprising:

a mounting bracket fixedly secured to an inner surface portion of said compartment;

one end of said linear actuator is adapted to engage said mounting bracket so as to cause said compartment to be moved to said OPEN position; and a return spring operatively connected to said mounting bracket so as to return said compartment from said OPEN position to said CLOSED position.

13. The furniture console as set forth in claim 11, further comprising:

a mounting bracket fixedly secured to an inner surface portion of said compartment;

one end of said linear actuator is operatively connected to said mounting bracket so as to cause said compartment to be moved to said OPEN position and back to said CLOSED position; and a power control unit operatively connected to said drive motor so as to limit the power generated by said drive motor if said compartment becomes jammed so as not to burn out said drive motor.

* * * * *